US006283120B1

(12) United States Patent
Kellon

(10) Patent No.: US 6,283,120 B1
(45) Date of Patent: Sep. 4, 2001

(54) VARIABLE VOLUME RATIO COMPOUND COUNTERLUNG

(75) Inventor: John P. Kellon, Garland, TX (US)

(73) Assignee: Carleigh Rae Corporation, Fort Lauderdale, FL (US)

( * ) Notice: Subject to any disclaimer, the term of this patent is extended or adjusted under 35 U.S.C. 154(b) by 0 days.

(21) Appl. No.: 09/003,409

(22) Filed: Jan. 6, 1998

(Under 37 CFR 1.47)

Related U.S. Application Data

(60) Provisional application No. 60/034,644, filed on Jan. 7, 1997.

(51) Int. Cl.[7] ..... A61M 16/00; A62B 7/04

(52) U.S. Cl. ..... 128/204.28; 128/204.26; 128/205.13; 128/205.22; 128/205.16

(58) Field of Search ..... 128/205.16, 204.26, 128/205.22, 205.28, 201.28, 204.23, 204.29, 204.28, 204.24, 205.13, 205.14

(56) References Cited

U.S. PATENT DOCUMENTS

| | | | | |
|---|---|---|---|---|
| 1,202,125 | * | 10/1916 | Tullar | 128/205.13 |
| 3,818,806 | * | 6/1974 | Fumagalli | 128/205.13 |
| 3,890,967 | * | 6/1975 | Elam et al. | 128/205.13 |
| 4,056,098 | * | 11/1977 | Michel et al. | 128/204.29 |
| 4,821,712 | * | 4/1989 | Gossett | 128/205.15 |
| 4,870,962 | * | 10/1989 | Sitnik | 128/205.13 |
| 4,939,647 | * | 7/1990 | Clough et al. | 128/201.27 |
| 5,315,988 | * | 5/1994 | Clarke et al. | 128/204.23 |
| 5,720,279 | * | 2/1998 | Furuichi et al. | 128/204.26 |
| 5,975,078 | * | 11/1999 | Pauley | 128/205.23 |

* cited by examiner

*Primary Examiner*—John G. Weiss
*Assistant Examiner*—Virendra K Srivastava
(74) *Attorney, Agent, or Firm*—Malin, Haley & DiMaggio, P.A.

(57) ABSTRACT

A variable volume ratio compound counterlung is disclosed for use with a semi-closed circuit breathing apparatus. The compound counterlung generally comprises a flexible bag member disposed within an outer counterlung member. The flexible bag member and the outer counterlung member are in communication with an exhaled gas area of a breathing loop. The flexible bag member having first and second ends which are attached to said outer counterlung. A pair of depth sensors operatively associated with the flexible bag member are provided to vary the volume of said flexible bag member with changes in depth. The flexible bag member is driven by the outer counterlung to discharge gas stored within the flexible bag member depending on the diver's respiratory minute volume. The collapsing of said outer counterlung member also returns gas stored within the outer counterlung back into the breathing loop. The volumetric capacity of the inner counterlung is controlled by one or more ambient pressure sensing devices with an outer bellows-type counterlung that drives the inner counterlung's contents overboard with each breathing cycle. The invention provides semi-closed cycle passive gas addition for recirculating diver breathing systems that is keyed to both respiratory minute volume and depth by making each discharge mass constant relative to the volumetric relationship of the inner and outer counterlungs at the surface, thus making the system far more gas efficient than previous designs.

20 Claims, 7 Drawing Sheets

VARIABLE VOLUME RATIO COMPOUND COUNTERLUNG

CROSS-REFERENCE TO RELATED APPLICATIONS

This application claims the benefit of U.S. Provisional Application No. 60/034,644, filed Jan. 7, 1997.

STATEMENT REGARDING FEDERALLY SPONSORED RESEARCH OR DEVELOPMENT

Not applicable.

BACKGROUND OF THE INVENTION

1. Field of the Invention

The present invention relates generally to a semi-closed circuit passive gas addition breathing apparatus and more particularly to a variable volume ratio compound counterlung used in a rebreathing apparatus.

2. Description of Related Art

Conventional semi-closed rebreathers operate by delivering a premixed gas from a scuba cylinder through a constant flow regulating device, usually by supplying a regulated gas supply to a changeable orifice. Gas is delivered at a preset rate regardless of depth. The gas being breathed is recirculated, and as the oxygen within the mixture is metabolically consumed, it is hopefully being adequately replaced on a continuous basis with a predetermined continuous flow of oxygen enriched gas.

Rebreathers consist of a breathing loop from which the diver inhales and into which the diver exhales. As most of the exhaled gas stays in the breathing loop, rebreathers allow for much greater gas efficiency than open circuit systems. This greater gas efficiency allows for longer duration dives as compared to open circuit systems, or, conversely, requires less gas supply for a dive of equal duration.

The breathing loop generally includes a relief valve, scrubber, counterlung, depth equalization regulator, continuous injection system, hoses and a mouthpiece. The relief valve is utilized for dumping or venting excess gas in the breathing loop created by the rebreather on ascent and excess gas which is produced with the use of constant (active) addition systems. The scrubber cleanses the exhaled gas of carbon dioxide. The counterlung or breathing bag allows for the retention of the diver's exhalation gas. The injection system adds fresh gas to the carbon dioxide cleansed gas in the breathing loop. The depth equalization regulator adds supply mix to the loop to keep pace with depth increases. The hoses are utilized to connect the counterlung and scrubber with the mouthpiece. The mouthpiece is connected to the two hoses and is the point on the breathing loop where the diver exhales and inhales. Typically, two conventional one-way valves are incorporated into the mouthpiece.

Rebreathers normally include a harness to strap the unit to the diver, with some units also including a protective case for the various above described components.

As stated above, rebreathers generally work by recycling most of a diver's exhaled breath, which travels through the breathing loop through the scrubber, and is returned to the diver during inhalation. The use of a rebreather allows a diver to remain underwater for a relatively long time as compared to the use of open circuit equipment.

Accordingly, rebreathers allow exhaled gas to be cleansed of carbon dioxide and replenished with fresh oxygen for further consumption. A traditional fixed flow (active addition) semi-closed rebreather recycles the gas the diver is breathing, removing excess carbon dioxide from the exhaled gas and replacing it with a measured amount of premixed gas to maintain an oxygen partial pressure in the inspired gas that will continue to support metabolism.

There are several previously known types of operating systems for semi-closed circuit rebreathers, including fixed discharge ratio, continuous injection and mechanically pulsed. In the 1970's, as electronically controlled rebreathers were coming into their own, a fixed discharge ratio counterlung (an inner bellows within an outer bellows) was developed for semi-closed use in Europe. This type of rebreather was coined the first "passive" addition or counter mass ratio system. "Passive" means gas is only added as required to replace gas that has been discharged from the breathing loop by the control mechanism.

The "passive" addition system discharged a fixed percentage of each exhalation overboard, thus responding to respiratory minute volume ("RMV") or work rate. As such, reasonably tight decompression schedules could be computed for semi-closed equipment, eliminating the need for complex electronic oxygen monitoring.

Any system keyed to RMV is essentially using the diver as a sensor. The passive system uses a proportional discharge valve or a bellows within a bellows to discharge a fixed percentage of every exhalation overboard. The missing part of the exhalation is made up "passively" by one or two demand regulators on the following inhalation. Excess gas in the breathing loop from reduced ambient pressure is vented off by an overpressure relief valve. The fixed discharged ratio units maintain reasonably steady oxygen fractions in the breathing loop. The counterlung does not have to be purged on normal ascents to prevent hypoxia.

One drawback with the fixed discharged ratio semi-closed circuit is that it is not as gas efficient as electronic closed circuit rebreathers or constant flow (active) semi-closed rebreathers due to the fact that gas usage increased with depth similar to open circuit equipment. Furthermore, different diver positions often caused gas to be lost. The increased gas usage limits dive duration at depth as compared to other types of semi-closed units. Thus, despite solving decompression problems the bellow within a bellow system was ultimately abandoned due to its limited dive duration capabilities.

The continuous injection system is an active addition system and typically bleeds a fixed flow of single source mixed gas into the breathing loop from a variable or changeable fixed orifice. The flow rate is determined by estimating the diver's work rate for the intended dive and hopefully ensuring that enough oxygen from the mixed gas supply enters the system to meet anticipated metabolic requirements. Hypoxia is possible if the counterlung is not purged during ascent. Additionally, extended periods of higher than anticipated work loads can also produce hypoxia.

The mechanically pulsed semi-closed rebreather is also an active system and uses a bellows counterlung to mechanically drive a ratchet/cam that pulses gas addition valves in approximate response to respiratory minute volume. The gas addition is from a single mixed gas supply and is regulated to provide reasonably tight oxygen fractions in the breathing loop. Excess gas in the breathing loop from additions or reduced ambient pressure is vented off by an overpressure relief valve. However, with this type of unit, there are more single point addition failure possibilities.

Accordingly, no prior RMV controlled recirculating breathing system has incorporated a mass-constant discharge capability. Thus, there exists a need for a "passive" gas addition semi-closed circuit rebreather unit which provides for a variable discharge ratio which changes with depth to effect a mass constant discharge ratio (to reduce gas wastage) that is controlled by the diver's RMV (to make the unit responsive to actual metabolic requirements). It is therefore, to the effective resolution of the aforementioned problems and shortcomings that the present invention is directed.

BRIEF SUMMARY OF THE INVENTION

The present invention provides a variable volume discharge ratio compound counterlung for use with a semi-closed circuit breathing apparatus. The entire breathing apparatus incorporating the compound counterlung provides for a variable discharge ratio semi-closed circuit rebreather unit which does not reduce in gas usage efficiency with depth. The compound counterlung consist of a variable volume discharge inner counterlung driven by and disposed within a weighted bellows (outer counterlung). The inner counterlung geometry is chosen such that there is always provided enough discharge capacity to exceed metabolic addition requirements, regardless of depth. The inner counterlung component arrangement takes advantage of both outer counterlung forces and exhalation pressures to ensure accurate volumetric sizing.

The inner counterlung reduces in volume with depth increase, allowing it to discharge exhalation gas inversely proportional to depth. As such, the same amount of mass is always discharged for any given RMV regardless of depth. The shortfall in the diver's subsequent inhalation is made by conventional redundant addition regulators, associated with the breathing loop. Addition is made when there is zero counterlung volume, thus reducing the gas in the breathing loop that is available to dilute the addition. The other components, which normally make up a rebreather, i.e. canister, scrubber, mouth piece, hoses, etc. can be conventional.

The system is keyed to respiratory minute volume, and makes a full and proportional oxygen correction with every breath. Accordingly, the system is reliable for holding steady inspired oxygen fractions, thus making use of standard programmable decompression computers and hard tables practical.

The variable discharge ratio makes the ejected portion of every breath mass constant relative to the tidal volume and breathing frequency, regardless of depth. Thus, the unit achieves an equal reclaim rate at depth as at surface. As such, the unit is five (5) times more efficient in gas use than an open circuit unit at the surface, and is twenty (20) times more efficient than an open circuit unit at 4 absolute atmospheres (99FSW).

Furthermore, as the present invention discharges part of every exhalation, loss of gas addition results in subsequently shorter volumes of gas available for each inhalation, making an addition failure immediately recognizable and hypoxia highly unlikely. Rational arrangement of the components in the breathing loop make other malfunctions immediately recognizable through other changes in breathing characteristics.

The volumetric capacity of the variable volume inner counterlung is controlled by one or more ambient pressure sensing devices. The depth sensing devices allow for pressure preloading to change the rate of inner counterlung volumetric changes relative to ambient pressures. Sensing device pressure envelopes are also provided that act as indicators for surface pressure registration, inner counterlung floods and bacterial growth. The depth sensing envelopes also allow for leak testing of the inner counterlung.

The outer bellows-type counterlung drives the inner counterlung's contents overboard with each breathing cycle. The inner bag control arrangement works in a plane perpendicular to the discharge driving motion, thus allowing for volumetric changes that do not affect the range of collapsing motion during the discharge cycle.

The present invention compound counterlung provides for semi-closed cycle passive gas addition for recirculating diver breathing systems that is keyed to both respiratory minute volume and depth by making each discharge mass constant relative to the volumetric relationship of the inner and outer counterlungs at the surface, thus, allowing for superior gas efficiency as compared to prior designs.

Some of the features of the present invention include, but are not limited to, the following:

(1) Depth sensing devices that allow for pressure preloading to change the rate of inner counterlung volumetric changes relative to ambient pressures;

(2) An inner bag control arrangement that works in a plane perpendicular to the discharge driving motion, thus allowing for volumetric changes that do not affect the range of collapsing motion during the discharge cycle;

(3) Depth sensing device pressure envelopes that act as indicators for surface pressure registration, counterlung floods and bacterial growth;

(4) Inner counterlung geometry that always provides enough discharge capacity to exceed metabolic addition requirements, regardless of depth;

(5) Inner counterlung component arrangement that takes advantage of both outer counterlung forces and exhalation pressures to insure accurate volumetric sizing; and (6) A discharge control valve that prevents any discharge during the fill (exhalation) cycle to insure accurate volumetric sizing of the inner counterlung under pressure.

Some of the benefits of the present invention include, but are not limited to, the following:

(1) Provides the most efficient use of gas possible in a system that is keyed to RMV while still maintaining the tight inspired oxygen fractions associated with passive addition semi-closed breathing systems;

(2) Provides for equalization with diving bell environments to extend depth range capabilities;

(3) Provides the ability to change inner counterlung volumetric change rates relative to ambient pressures by applying a pressure or vacuum bias to the pressure sensing devices prior to the dive. This allows for the use of mixed gases in specialized diving applications that would not be usable otherwise;

(4) Provides for easy identification of pressure sensor leaks or miscalibrations;

(5) Provides for easy identification of counterlung leaks;

(6) Provides for easy identification of counterlung contaminants; and (7) Provides for safe inspired oxygen fraction levels even if the counterlung proportioning mechanism or depth sensor(s) fail.

Accordingly, it is an object of the present invention to provide a variable volume ratio compound counterlung as part of a passive addition semi-closed circuit rebreather which is more efficient in gas usage as compared to prior art counterlungs.

It is another object of the present invention to provide a variable volume ratio compound counterlung as part of a passive addition semi-closed circuit rebreather which provides the most efficient use of gas possible in a system that is keyed to respiratory minute volume while still maintaining tight inspired oxygen fractions associated with prior art passive addition semi-closed breathing systems.

It is yet another object of the present invention to provide a variable volume ratio compound counterlung as part of a passive addition semi-closed circuit rebreather which provides for equalization with diving bell environments to extend depth range capabilities.

It is still another object of the present invention to provide a variable volume ratio compound counterlung as part of a passive addition semi-closed circuit rebreather which provides the ability to change inner counterlung volumetric change rates relative to ambient pressures by applying a pressure or vacuum bias to pressure sensing devices prior to the dive, allowing for the use of mixed gases in specialized diving applications not otherwise usable with prior art devices.

It is even still another object of the present invention to provide a variable volume ratio compound counterlung as part of a passive addition semi-closed circuit rebreather which provides for easy identification of pressure sensor leaks or miscalibrations.

It is a further object of the present invention to provide a variable volume ratio compound counterlung as part of a passive addition semi-closed circuit rebreather which provides for easy identification of inner counterlung leaks.

It is still a further object of the present invention to provide a variable volume ratio compound counterlung as part of a passive addition semi-closed circuit rebreather which provides for easy identification of counterlung contaminants.

It is still a further object of the present invention to provide a variable volume ratio compound counterlung as part of a passive addition semi-closed circuit rebreather which provides for safe oxygen fraction levels even if the counterlung proportioning mechanism and/or depth sensor (s) fail.

In accordance with these and other objects which will become apparent hereinafter, the instant invention will now be described with particular reference to the accompanying drawings.

BRIEF DESCRIPTION OF THE SEVERAL VIEWS OF THE DRAWINGS

The invention may be better understood by reference to the drawings in which.

DETAILED DESCRIPTION OF THE INVENTION

Figure 1:
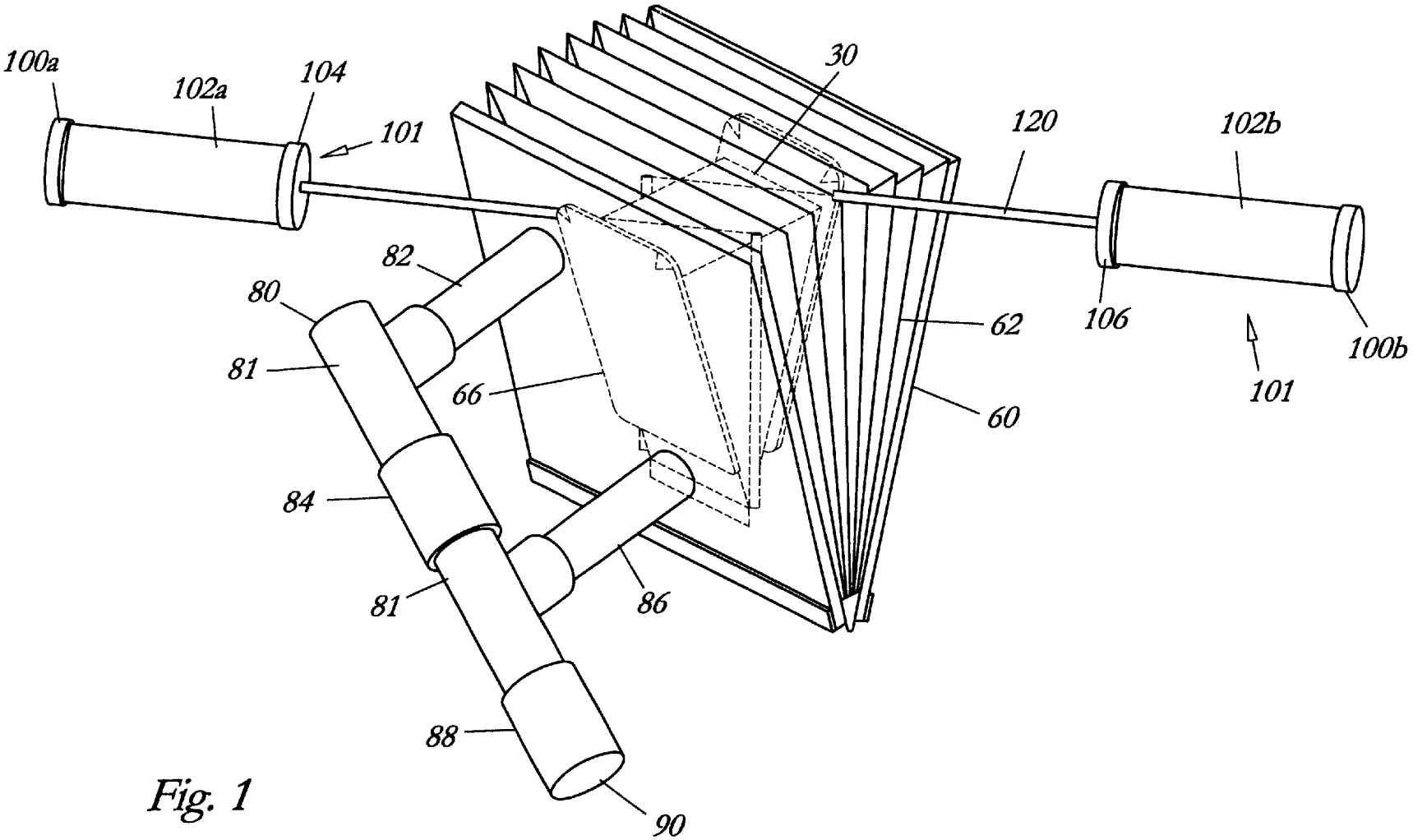
FIG. 1 is a perspective view of the variable volume ratio compound counterlung in accordance with the present invention.
Figure 2:
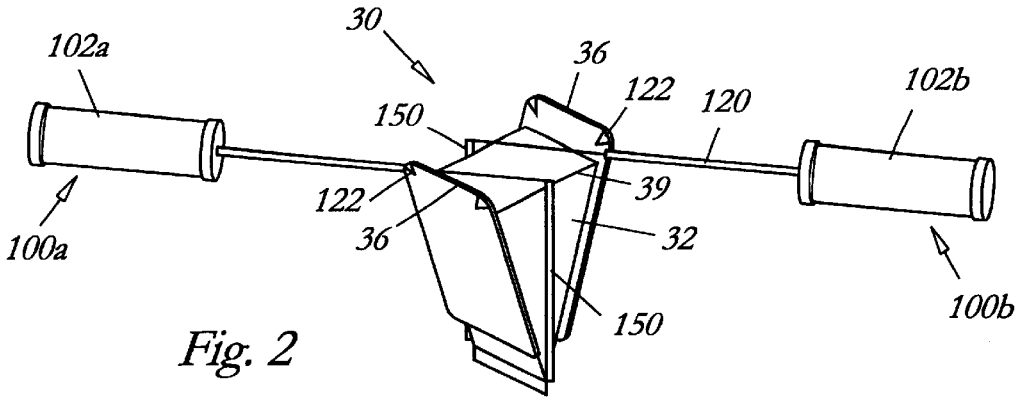
FIG. 2 is a perspective view of the inner bag member and associated depth sensors of the variable volume ratio compound counterlung.

As seen in the drawings a compound counterlung is provided and is generally designated as reference numeral 20. The compound counterlung consists of an inner counterlung 30 and an outer counterlung 60. Inner counterlung 30 includes a flexible bag 32 and comprises a depth controlled variable volume inner bag system which is enclosed within, attached to and driven by outer counterlung 60. Outer counterlung includes an accordion-like shaped bellow body member 62.

Exhaled gases enter a manifold inlet 80 through a tube 81 (primary gas path), which is in communication with an exhaled gas hose or conduit of a breathing loop, such as breathing loop 200 (FIG. 7), and pass through into outer counterlung 60 through outer tube 82 (first auxiliary gas path) and into inner counterlung 30 through non-return valve 84 and inner tube 86 (second auxiliary gas path). The components of manifold inlet 80 (tube 81, tube 82 and tube 86) can be transparent.

A flexible bag member 32 which is capable of retaining gas within its walls is preferably provided for the inner counterlung system 30. A pair of inner counterlung plates 36 are attached to the outer surface of respective opposite ends of flexible bag member 32 by conventional means. Likewise a pair of outer counterlung plates 66 are attached to the inner surface of respective opposite ends of outer bellow members 62. Plates 36 and 66 are provided for attaching inner counterlung 30 to outer counterlung 60, as respective plates 36 and 66 mate with each other.

As the inner counterlung 30 is attached to outer counterlung 60 it is filled both by exhalation pressure and suction created by the expanding outer counterlung 60. Ambient gas or water is prevented, by a non-return valve 88, from entering inner counterlung 30 through discharge outlet 90.

At the surface, regardless of its volume, the exhalation gas is distributed between inner and outer counterlungs 30 and 60, respectively, in the ratio determined by the physical volumetric maximum capacities of counterlungs 30 and 60, in relation to each other. This ratio is typically from 20%/80% to 25%/75%. As an example, with a ratio of 25%/75%, a two (2) liter exhalation by the user would enter compound counterlung 20 with 1.5 liters passing into outer counterlung 60 and 0.5 liter passing into inner counterlung 30.

After exhalation, on the following inhalation by the user (diver), the contents (gas) is drawn out of outer counterlung 60 through outer tube 82 and manifold inlet 80 where the contents re-enters the breathing loop. The drawing out process causes the collapse of bellow member 62 which in turn squeezes the attached bag member 30 to drive the contents of bag member 30 out through inner tube 86. Non-return valve 84 prevents the drawn out contents of bag member 30 from re-entering the breathing loop. As such, the drawn out contents (gas) is discharged through non-return valve 88 and discharge outlet 90 into the ambient air or water.

At the end of the inhalation, approximately twenty-five (25%) percent of the gas volume needed to fill the diver's lungs is missing. This gas is made up from a supply source by a conventional demand regulator, an additional valve 63 tripped by the collapsed outer counterlung 60 (FIG. 7), or both. There is enough oxygen present in the new gas to meet metabolic demands regardless of the diver's exercise level, as respiratory minute volume (lung ventilation, more breaths per minute or more tidal volume per breath or both) will change in direct response to oxygen needs. Thus, the present invention uses the diver him or herself as an oxygen sensor and makes a full correction in the inspired oxygen fraction with every breath.

At the surface, inner counterlung 30 expands to full capacity, as it has not been subjected to any control of its capacity by depth sensors 100*a* and 100*b*. Depth sensors 100*a* and 110*b* are each provided with volume control components. Inner counterlung 30 and the pressure envelope provided by sensor housing 102, first and second housing caps 104 and 106, and a plurality of flexible tubes 120 are all sealed as a common pressure enclosure 101. Sensor housing 102 can be transparent (FIG. 6) to allow monitoring of the bellow member 110/control rod 112 disposed within. Sensor housing 102 being transparent also allows for detection of water and/or organic growth in housing 102 which normally indicates water and/or organic growth in inner counterlung 30.

As the diving depth (ambient pressure) increases, the pressure in common pressure enclosure 101 and compound counterlung 20 increases proportionally, with gas additions from an underpressure or demand valve being made periodically when counterlung 20 collapses fully to provide an adequate volume of gas to maintain pressure equalization between counterlung 20 and the ambient.

A control bellow 110 is disposed within sensor housing 102 and is affixed at one end to first housing cap 124 and to control rod 112 at its outer end 111. Control bellow 110 constitutes an independent pressure enclosure that can be adjusted with pressure or vacuum preloads at the surface through adjustable valve 130 to retard or advance inner counterlung 30 control as needed for specialized diving conditions, such as deep bell operations.

During normal operation, control bellow 110 is equalized with the air at the surface by opening and closing valve 130. This opening and closing of valve 130 calibrates the interior pressure of sensor housing 102 to ambient pressure at the surface and provides a zero reference point where the traveling end 111 of bellow 110 aligns with a corresponding point on transparent sensor housing 102. When pressure outside control bellows 110 increases to equalize with a greater ambient pressure (depth), control bellow 110 shortens proportionally through range 103, shown on sensor housing 102 (FIG. 6*a*), to equalize its interior pressure with the pressure around it.

Figure 6A:
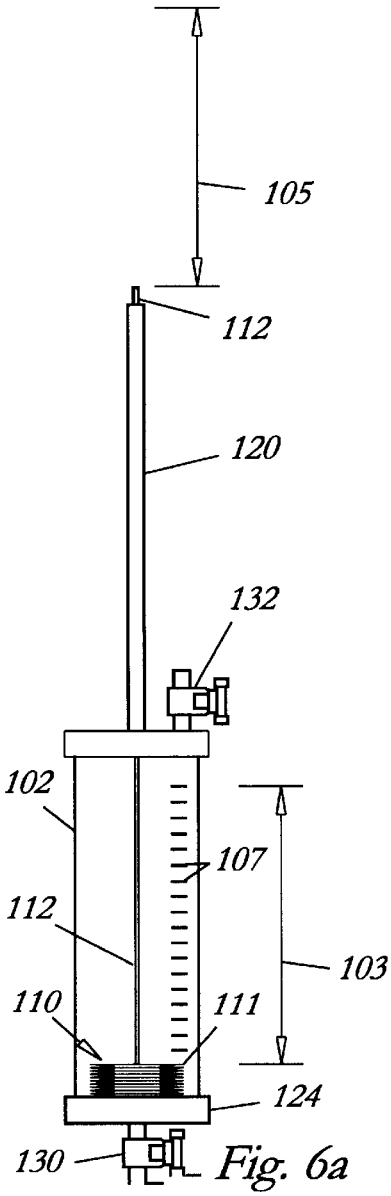
FIG. 6*a* is a front view of a depth sensor in accordance with the present invention illustrating the sensor bellow in a fully compressed position.

As one end of bellow 110 is attached to first housing cap 104, only end 111 moves to provide for equalization. As stated above a first end of control rod 112 is affixed to control bellow 110 at movable end 111. Thus, the movement of end 111 also proportionally draws inward control rod 112 to produce a reduction of control rod 112's extension beyond flexible tube 120 through a range 105 (FIG. 6*a*). Thus, the amount of reduction of the extension of control rod 112 beyond tube 120 is in direct proportion to the motion of control bellow 110 through range 103.

The opposite ends of each control rod 112 is attached to a respective control arm 150. Control arms 150 are affixed to flexible sides of bag member 32 at their narrowest point 31 (adjacent the point on each side wall 43 where end walls 45 meet) by conventional means. Control arms 150 run along and adjacent to their respective side walls 43. The narrowest portion of inner counterlung 30 is attached to outer counterlung 60 at a flap 40. This attachment at flap 40 prevents control arms 150*a* and 150*b* from being drawn toward one another at the flap 40 attachment point. However, control arms 150*a* and 150*b* are allowed to move with the rest of the mechanism at the wide portion 39 of inner counterlung, where control rods 112*a* and 112*b* are attached to control arms 150*a* and 150*b*, respectively.

Figure 3:
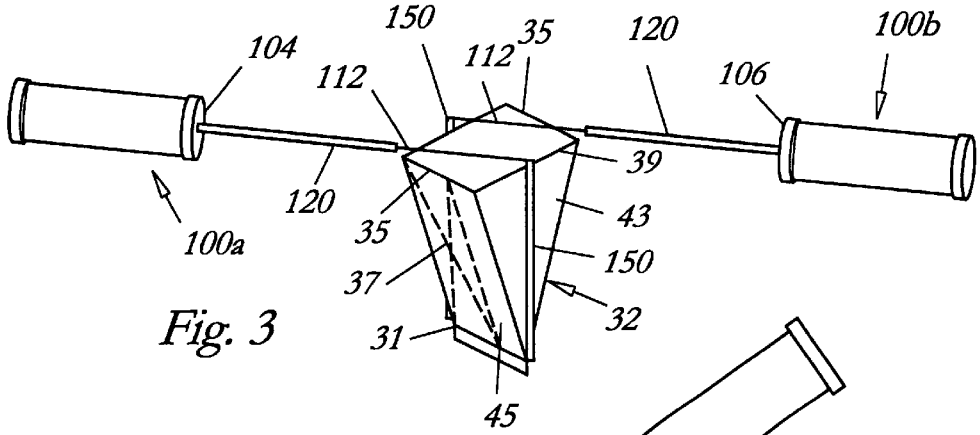
FIG. 3 is a perspective view of the inner bag member and associated depth sensors of the variable volume ratio compound counterlung with the mounting plates removed.

Ends 122 of each flexible tube 120 are affixed to respective plates 36. Plates 36 are attached to outer counterlung bellow plates 66, allowing flexible bag member 32 to move as a compound unit 20 with expansion and contraction of outer counterlung 60. The static sides 35 of inner counterlung 30 (bag member 32) are cemented to their respective plate 36 at area 37 (FIG. 3). This allows redefinition of inner counterlung 30 (bag member 32) side geometry solely by control arms 150, while allowing the plate attachment sides of bag member 32 to follow the motion of counterlung plates 36, which are controlled by outer counterlung 60.

Figure 4:
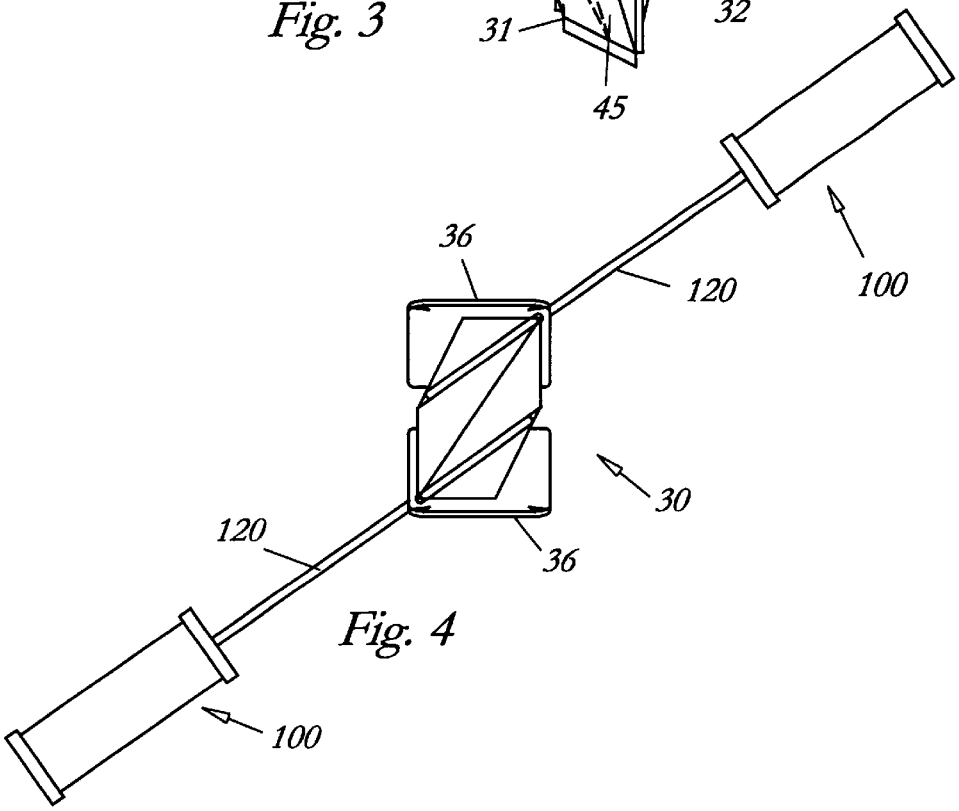
FIG. 4 is a top view of the inner bag member and associated depth sensors illustrated in FIG. 2 and illustrating the shape of the bag member when the control bellow within the depth sensor is fully compressed.
Figure 5:
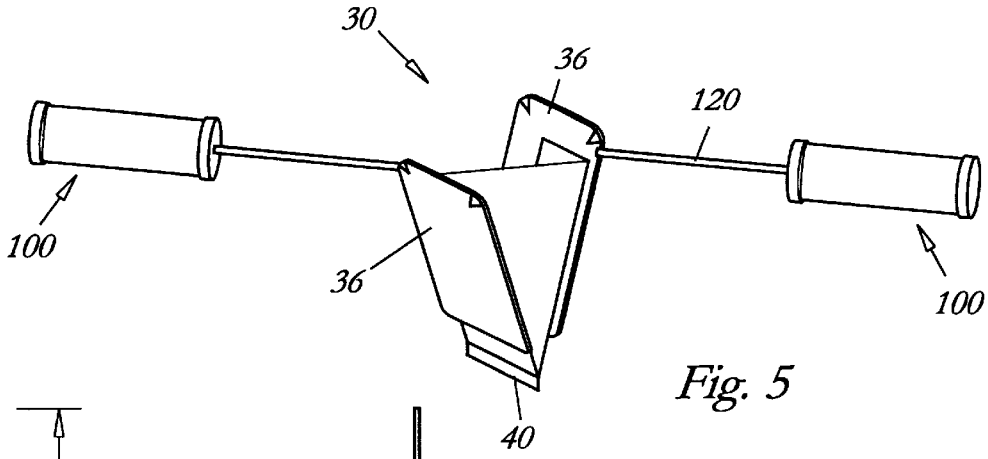
FIG. 5 is a perspective view of the inner bag member and associated depth sensor illustrated in FIG. 2 and illustrating the shape of the bag member when the control bellow within the depth sensor is fully compressed.

In use, as depth increases, collapsing control bellows 110 of each depth sensor 100 pulls its corresponding control rod 112 inward. This inward movement causes control arms 150, which are attached to respective control rods 112, to move toward the opposite side of inner counterlung 30 in conversely parallel motions to avoid interference with one another, which changes the shape of flexible bag member 32, and simultaneously varies the volume of flexible bag member 32. FIGS. 4 and 5 illustrate the shape of inner counterlung 30 with a maximum range of travel of bellows 110 (fully collapsed—FIG. 6*a*) . The shape of inner counterlung 30 in FIGS. 4 and 5 allows for substantial volume control without restricting the travel of inner and outer counterlung plates, which must be unimpaired to respond to varying tidal volumes. The discharged volume proportion determined by controlling inner counterlung 30 is inversely proportional to depth changes, thus making the discharge mass constant relative to respiratory minute volume.

When the maximum travel of the volume proportioning control mechanism (control bellows 110) has been reached (i.e. approximately 13 atmospheres absolute), control arms 112 will remain fully drawn in. The shape of bag member 32 remains the same due to the fact that the position of control bellows 110, control rods 112 and control arms 150 remains constant after maximum bellow 110 travel has occurred. Thus, inner counterlung 30 (flexible bag member 32) will continue to eject the amount of gas that was being ejected when mechanism (bellow 110) travel ceased. At this point, gas use efficiency is reduced with further increases in depth, unless control bellow 110 is preloaded with pressure through valve 130 prior to the dive or equalized in a bell or chamber at depth through valve 130, thus shifting the range of mechanism travel. Mechanism (control bellow) travel can be reduced for use with supply gases containing high fractions of oxygen in shallower water by applying a vacuum bias to control bellows 110 through valve 130 prior to the dive.

The present invention works in reverse for depth decreases as that described above for depth increases. Thus, inner counterlung 30 is restored to volumetric capacities that automatically assure enough passive gas addition to meet metabolic requirements regardless of depth.

After the dive, gas tight integrity of control bellow 110 on each depth sensor 100 can be performed by determining if traveling end 111 of control bellow 110 aligns with a pre-dive registration mark 107 on transparent housing 102. Water or organic growth in inner counterlung 30 can be detected by the presence of either or both in housing 102. Loss of pressure integrity in inner counterlung 30 or non-return valve 84 can be detected by blocking discharge outlet 90 and applying a small amount of gas pressure to the system through valve 132. Loss of vacuum integrity in inner counterlung 30 or non-return valve 88 can be detected by blocking manifold inlet 80 and applying a small vacuum to the system through valve 132.

Figure 7:
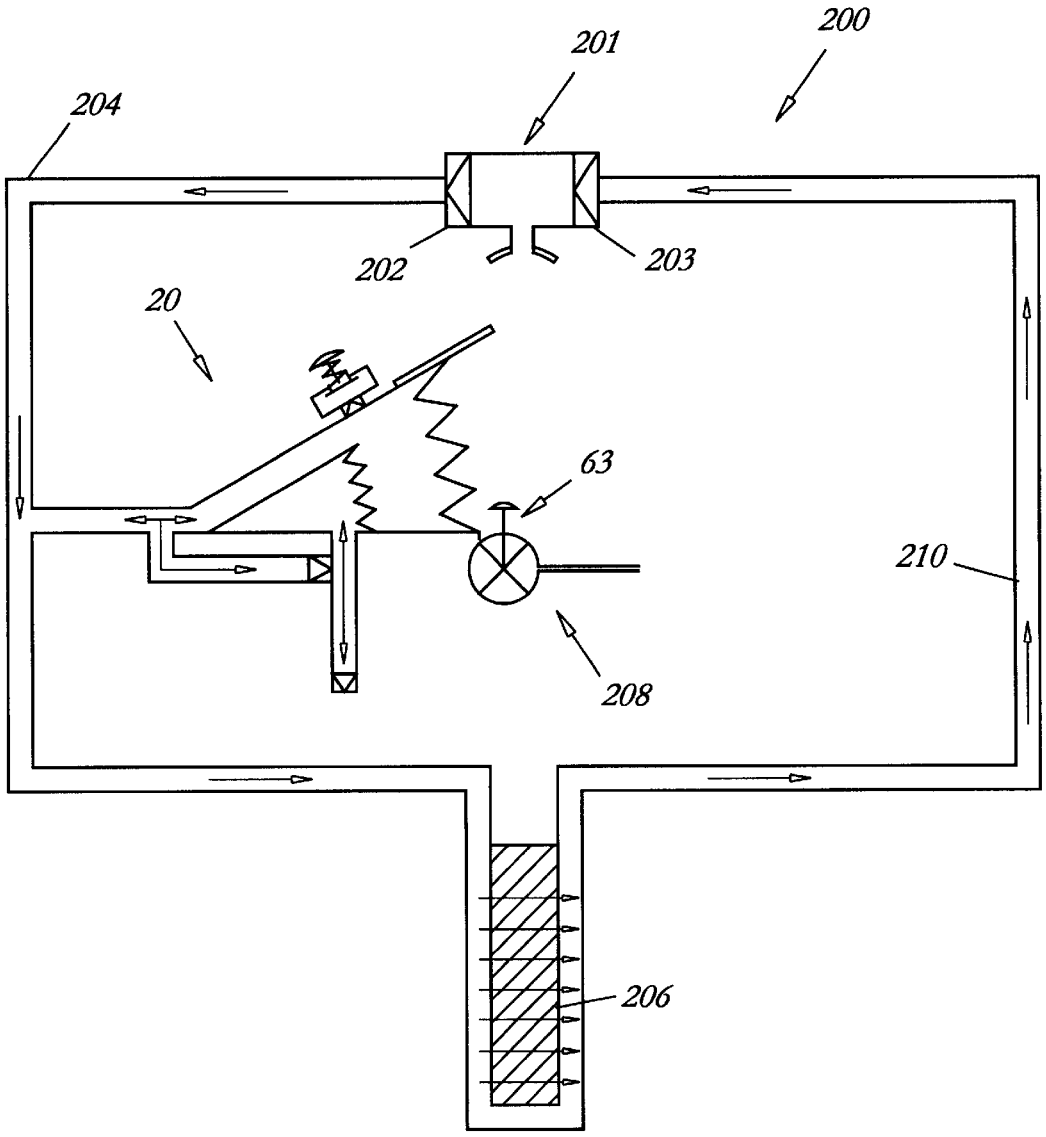
FIG. 7 is a breathing loop schematic for a passive addition semi-closed circuit breathing apparatus incorporating the variable volume ration compound counterlung of the present invention.

FIG. 7 illustrates one embodiment for a breathing loop 200 incorporating variable volume ratio compound counterlung 20. Breathing loop 200 generally consist of a conventional mouthpiece 201 incorporating conventional one-way valves 202 and 203, a conventional exhaled breath path (hose) 204, compound counterlung 20 in accordance with the present invention, a conventional scrubber (canister) 206, one or more conventional regulator(s) 208 and a conventional inhaled breath path 210. The configuration of breathing loop 200 is shown by way of example and should not be considered limiting.

Accordingly, other breathing loop configurations incorporating compound counterlung 20 can be utilized and are considered within the scope of the invention. Furthermore, compound counterlung 20 can be utilized with other types of rebreathing apparatuses.

Figure 8:
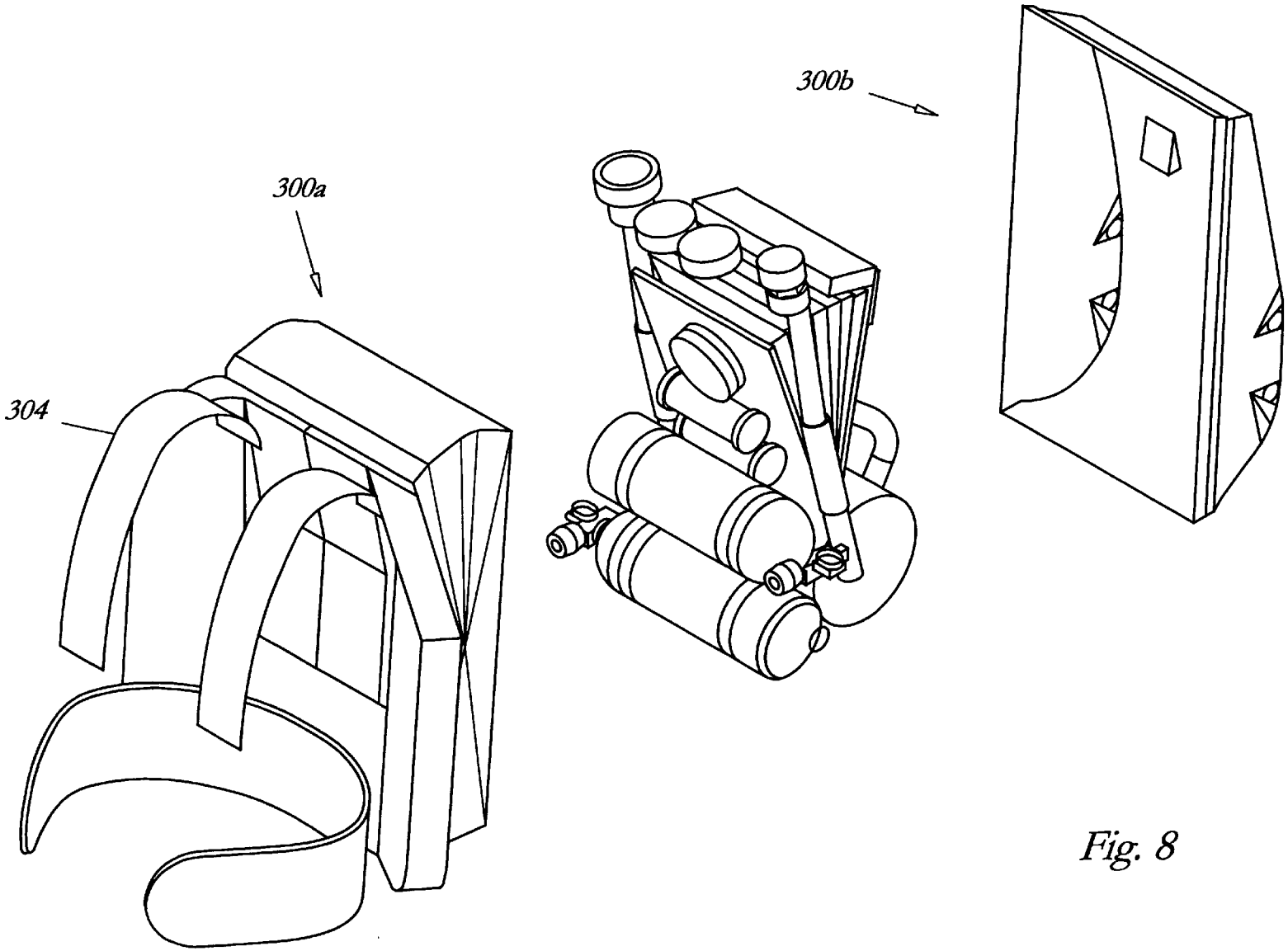
FIG. 8 is an exploded perspective view of one embodiment of the rebreathing unit incorporating the variable volume ratio compound counterlung also illustrating a protective case which can be utilized to protect the various components of the rebreathing unit.

Additionally, a conventional harness can be provided to strap the rebreathing unit to the diver. A protective case 300*a* and 300*b* (FIG. 8), with attachment straps 304 affixed to the outer surface of the case, can also be provided for the rebreathing unit. The case provides protection to the various components of the rebreathing unit.

Accordingly, the compound counterlung of the present invention provides many advantages including the following (1) utilizing a variable volume control device to automatically achieve mass constant passive gas addition at varying depths; (2) utilizing a pressure differential control mechanism to change the volumetric relationship between the two counterlung elements; (3) changing the volumetric capacity of one or both counterlung elements by reducing its ability to expand in one axis while retaining full movement in another axis; (4) utilizing a variable volume control device that provides for external verification of gas tight integrity in the inner counterlung and/or related non-return valves during positive and/or negative pressure loads; (5) providing for indication of interior conditions by using a transparent housing element that is part of an externally mounted variable volume control device; (6) utilizing an external proportioning control device that is atmospherically common to any part of the interior of the counterlung to prevent loss of breathing loop integrity if the pressure sensing element fails; (7) providing for external equalization or pressure/vacuum bias of the depth sensing element of the proportioning control system; (8) providing for external verification of gas tight integrity and/or pressure/vacuum preload condition of the pressure sensing elements; (9) utilizing a remote pressure sensing element that transfers proportioning control to the interior of either counterlung through a flexible control rod moving in a flexible guide; (10) providing a compound counterlung which utilizes both a bellow and a variable volume bag element; (11) linking the discharge of the variable volume inner bag to the motion of an external bellow; (12) providing an inner bag which is controlled by creating overlapping folds in the bag material to achieve greater volumetric capacity reduction; (13) providing a compound counterlung which prevents total inner counterlung volumetric capacity reduction by limiting the travel of the control mechanism at one end of the bag; and (14) providing a compound counterlung that uses both a physical link between the inner and outer counterlungs and exhalation pressure to help expand the inner counterlung to the limits dictated by a proportioning control mechanism.

Figure 9:
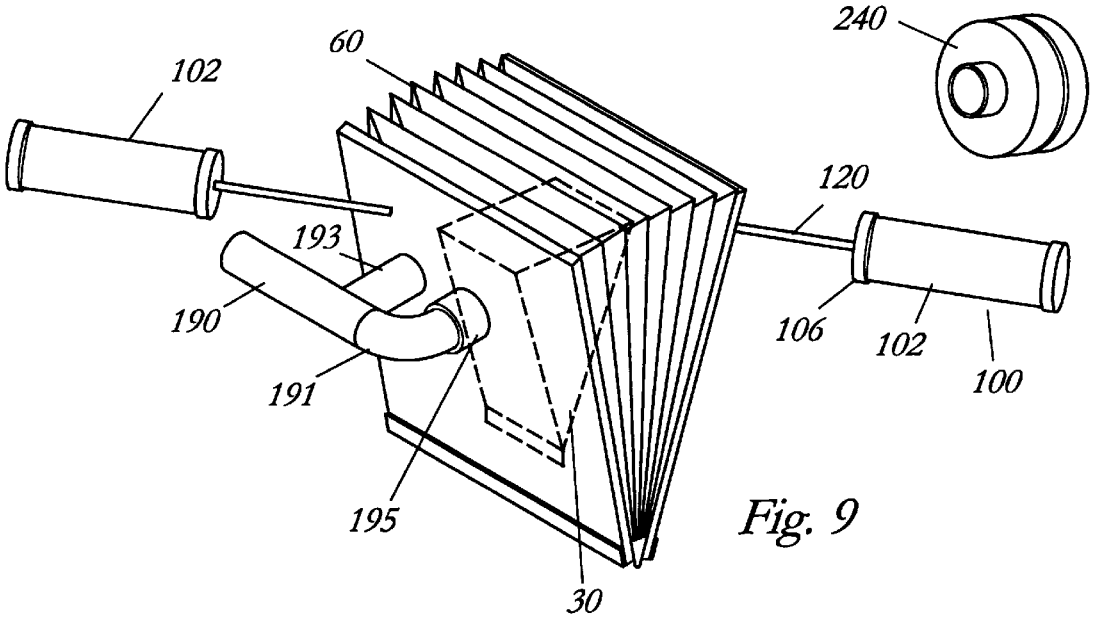
FIG. 9 perspective view of the variable volume ratio compound counterlung in accordance with the present invention.
Figure 11:
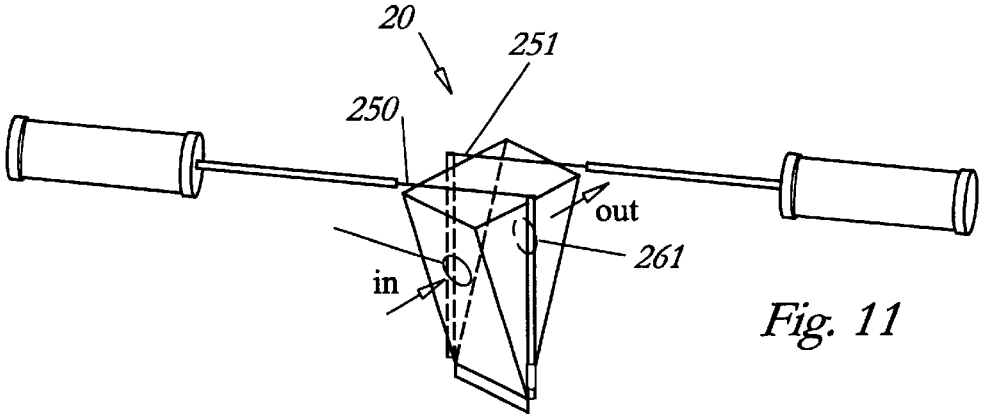
FIG. 11 is a perspective view of the inner bag member and associated depth sensors of the variable volume ratio compound counterlung.
Figure 10:
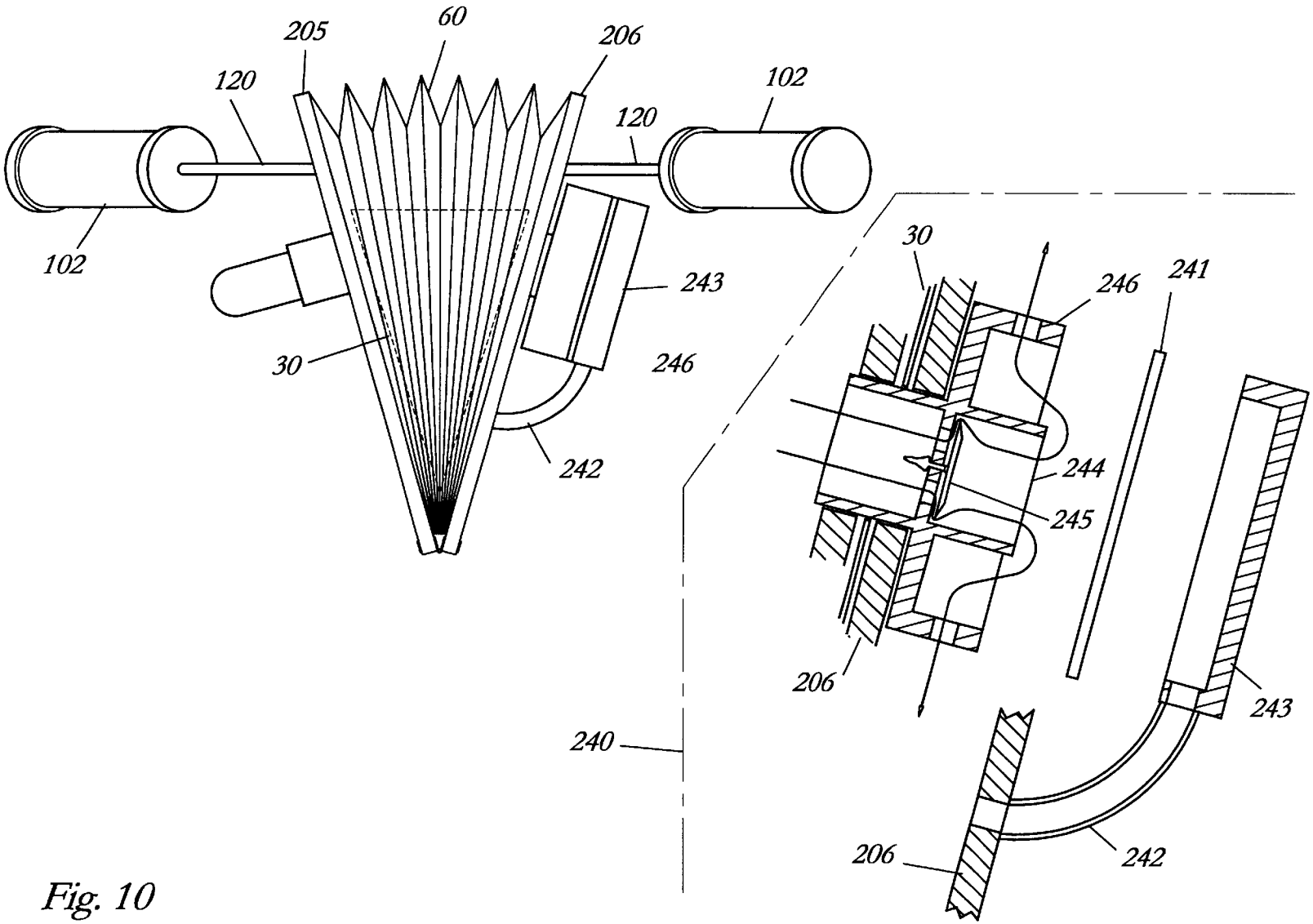
FIG. 10 is a side view of the variable volume ratio compound counterlung in accordance with the present invention.

The operation of the present invention will be discussed below. As stated above, the compound counterlung consists of a depth controlled variable volume inner bag 30 enclosed within, attached to and driven by an outer bellows 60, which in addition to the above figures is also illustrated in FIGS. 9, 10, and 11. Exhaled gas enters the manifold inlet 190 and passes into the outer counterlung 60 through tube 193 and the inner counterlung 30 through tube 191 and non-return valve 195. No discharge to ambient through discharge control valve 240 can occur because the positive pressure of the exhalation expanding the bellows 60 is transmitted to an elastomeric discharge control diaphragm 241 through tube 242 and sealing chamber 243.

This pressure forces the diaphragm against discharge outlet 244 with considerable hydraulic advantage because the diaphragm is a much larger diameter than the discharge outlet. The inner counterlung 30 is filled both by exhalation pressure and suction created by the expanding outer counterlung 60 because it is attached at outer counterlung plates 205 and 206. Ambient gas or water is prevented from entering inner counterlung 30 through discharge outlet 244 by non-return valve 245.

At the surface, regardless of its volume, the exhalation gas is distributed between the two counterlungs in the ratio determined by the physical volumetric maximum capacities of the counterlungs in relation to one another, typically 20%/80% of 25%/75%. Using the latter ratio, a 2 liter exhalation would enter the compound counterlung with 1.5 liters going to the outer counterlung 2 and 0.5 liter going to the inner counterlung 30.

On the following inhalation, the contents are drawn out of the outer counterlung 60 through tube 193 and manifold inlet 190. The contents of the inner counterlung are prevented from reentering the breathing loop by non-return valve 195. The negative pressure created by the inhalation within the bellows 60 is transmitted to the discharge control diaphragm 241 through tube 242 and sealing chamber 243, lifting it away from the discharge outlet 244 and allowing the contents of the inner counterlung to be discharged to the ambient environment through diffuser 246. The collapsing outer counterlung 60 squeezes the inner counterlung 30 and drives its contents overboard through the discharge control valve 240.

At the end of the inhalation, 25% of the gas volume needed to fill the diver's lungs will be missing. This gas is made up from a supply source by an addition valve tripped by the collapsed outer counterlung. There is enough oxygen present in the new gas to meet metabolic demands regardless of the diver's exercise level, because respiratory minute volume (more breaths per minute or more tidal volume per breath or both) will change in direct response to metabolic oxygen needs. This type of system is using the diver himself as an oxygen sensor and makes a full correction in the inspired oxygen fraction with every breath.

At the surface, the inner counterlung 30 is able to expand to its full capacity (see FIG. 11) because it has not been subjected to any control of its capacity by the depth sensors 102 and their related volume control components. The outer counterlung (bellows) and the pressure envelope provided by the sensor housings, housing caps, and flexible tubes are all sealed as a common pressure enclosure. As the diving depth (ambient pressure) increases, the pressure in the aforementioned enclosure and the entire compound counterlung increases proportionately (see FIG. 6).

Control bellows 110 is affixed to cap 124 at one end and flexible control rod 122 at the other end, and constitutes a completely separate pressure enclosure that can be adjusted with pressure or vacuum preloads at the surface through valve 130 to retard or advance inner counterlung control as needed to specialized diving conditions, such as deep bell operations. For normal operation, the control bellows is equalized with the air at the surface by opening and closing valve 130. This calibrates the interior pressure to ambient pressure at the surface and provides a zero reference point where the traveling end of the bellows aligns with a corresponding place on transparent sensor housing 102.

When the pressure outside control bellows 110 increases to equalize with a greater ambient pressure (depth), the control bellows shortens proportionately through range 103 to equalize its interior pressure with the pressure around it. Because one end of the control bellows is fixed to cap 124, only the other (traveling) end can move to allow equalization, drawing control rod 112 with it and producing a reduction of the control rod's extension beyond the end of flexible tube 120 through range 105 in direct proportion to the motion of the control bellows through range 103.

The ends of control rods 250 and 251 are affixed to control arms 150 which are in turn affixed to the flexible sides of inner counterlung 30 at their narrowest point 31. The narrowest portion of the inner counterlung is in turn affixed to the outer counterlung at flap 40, preventing the control arms to move with the rest of the mechanism at the other end. The inboard ends of the flexible tubes 120 are affixed to the outer counterlung lung bellows plates so that they all move as a unit with counterlung expansion and contraction. The static sides of the inner counterlung are sealed at their plates by port fittings at 260 and 261 to allow redefinition of the inner counterlung side geometry with control rods 250 and 251, while allowing the other (static) sides to follow the motion of the counterlung plates.

Figure 12:
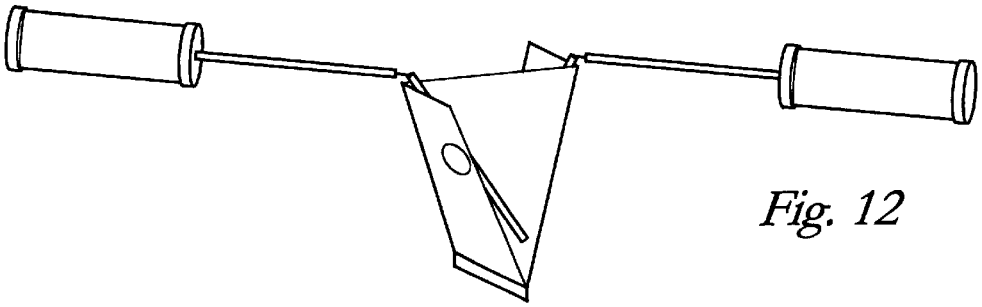
FIG. 12 is a perspective view of the inner bag member and associated depth sensor illustrated in FIG. 11 and illustrating the shape of the bag member when the control bellow within the depth sensor is fully, therefore compressed.

As depth increases, the collapsing control bellows 110 (see FIG. 6) of each sensor unit draws its corresponding control rod 112, at 250 and 251, and control arm 150 (see FIG. 12) toward the opposite side of the inner counterlung in conversely parallel motions to avoid interference with one another, with the maximum range of travel producing the inner counterlung shape shown in FIG. 12. This shape allows for substantial volume control without restricting counterlung plate travel, which must be unimpaired to respond to varying tidal volumes. The discharged volume proportion determined by the controlling of the inner counterlung is inversely proportional to depth changes, thus making the discharge mass constant relative to RMV.

After maximum travel of the volume proportioning control mechanism has been reached (typically at around 13 atmospheres absolute), the inner counterlung will continue to eject the amount of gas that was being ejected when mechanism travel ceased, thus reducing gas use efficiency with further depth increase, unless the control bellows 110 (see FIG. 6) has been preloaded with pressure through valve 130 prior to the dive or equalized in a bell or chamber at depth through the same valve, thus shifting the range of mechanism travel. Mechanism travel can be reduced for use with supply gases containing high fractions of oxygen in shallower water by applying a vacuum bias to the control bellows 110 through valve 130 prior to the dive.

The proportioning mechanism and compound counterlung will work in reverse during depth decreases, restoring the inner counterlung to volumetric capacities that automatically assure enough passive gas addition to meet metabolic requirements regardless of depth.

After the dive, gas tight integrity of the control bellows 110 (see FIG. 6) is verified on each depth sensor by seeing if the traveling end of the bellows aligns with the pre-dive registration mark 107 on the transparent housing 102. Water or organic growth in the inner counterlung can be detected by the presence of either or both in the same housing.

Figure 6B:
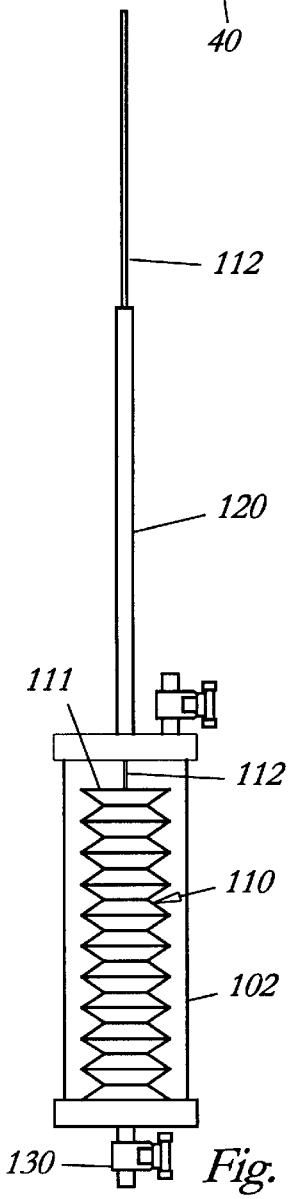
FIG. 6*b* is a front view of a depth sensor in accordance with the present invention illustrating the sensor bellow in a fully expanded position.

Loss of pressure integrity in the inner counterlung 30 or non-return valve 195 (see FIG. 9) can be detected by blocking the discharge outlet and applying a small amount of gas pressure to the system through valve 132 (see FIG. 6). Loss of vacuum integrity in the inner counterlung 30 or non-return valve can be detected by blocking manifold inlet 190 and applying a small vacuum to the system through valve 132.

Applicant also incorporates by reference the disclosure of its co-pending application entitled Balanced Breathing Loop Compensating Resistive Alarm System and Lung Indexed Biased Gas Addition for any Semi-Closed Circuit Breathing Apparatus and Components and Accessories Therefor which was filed on Jan. 6, 1998.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A variable volume ratio compound counterlung for use with a semi-closed circuit breathing apparatus, said breathing apparatus including a breathing loop to allow a majority of exhaled gas to travel therethrough and be cleansed of carbon dioxide and ultimately inhaled by a diver utilizing the breathing apparatus, said compound counterlung comprising:

a flexible bag member for communication with an exhaled gas area of the breathing loop;

an outer counterlung member for communication with an exhaled gas area of the breathing loop, said flexible bag member disposed within said outer counterlung member;

means for varying the volume of said flexible bag member with changes in depth; and means for discharging gas stored within said flexible bag member depending on the diver's respiratory minute volume;

wherein said flexible bag member is driven by said outer counterlung member to discharge gas stored within said flexible bag member;

wherein collapsing of said outer counterlung member also returns gas stored within said outer counterlung member back into the breathing loop;

wherein the relationship between said outer counterlung member, said flexible bag member, said means for varying and said means for discharging provides for semi-closed cycle passive gas addition that is keyed to both respiratory minute volume and depth by making each discharge mass constant relative to an volumetric relationship of said flexible bag member and said outer counterlung member at surface.

2. The variable volume ratio compound counterlung of claim 1 wherein said means for varying are a pair of depth sensors which act as pressure differential control mechanism to change the volumetric relationship between said flexible bag member and said outer counterlung member.

3. A variable volume ratio compound counterlung for use with a semi-closed circuit breathing apparatus, said breathing apparatus including a breathing loop to allow a majority of exhaled gas to travel therethrough and be cleansed of carbon dioxide and ultimately inhaled by a diver utilizing the breathing apparatus, said compound counterlung comprising:

a flexible bag member for communication with an exhaled gas area of the breathing loop;

an outer counterlung member for communication with an exhaled gas area of the breathing loop, said flexible bag member disposed within said outer counterlung member;

means for varying the volume of said flexible bag member with changes in depth; and means for discharging gas stored within said flexible bag member depending on the diver's respiratory minute volume;

wherein said means for varying are a pair of depth sensors which act as pressure differential control mechanism to change the volumetric relationship between said flexible bag member and said outer counterlung member;

wherein each of said pair of depth sensors comprising:

a housing member;

a control bellow member having a first end and a second end and disposed within said housing member, said bellow member attached at the first end to said housing member;

a control rod having a first end and a second end, the first end of said control rod disposed within said housing member and attached the second end of said bellow member;

a control arm having a first end and a second end, the first end of said control arm attached to the second end of said control rod, the second end of said control arm attached to said flexible bag member.

4. The variable volume ratio compound counterlung of claim 3 wherein said housing member is transparent.

5. The variable volume ratio compound counterlung of claim 3 wherein changes in depth causes said control bellow member to either compress or expand which in turn also moves said control rod and said control arm simultaneously, wherein the movement of the control arms of said pair of depth sensors varies the volume of said flexible bag member accordingly.

6. A variable volume ratio compound counterlung for use with a semi-closed circuit breathing apparatus, said breathing apparatus including a breathing loop to allow a majority of exhaled gas to travel therethrough and be cleansed of carbon dixoide and ultimately inhaled by a diver utilizing the breathing apparatus, said compound counterlung comprising:

a flexible bag member for communication with an exhaled gas area of the breathing loop;

an outer counterlung member for communication with an exhaled gas area of the breathing loop, said flexible bag member disposed within said outer counterlung member;

means for varying the volume of said flexible bag member with changes in depth; and means for discharging gas stored within said flexible bag member depending on the diver's respiratory minute volume;

wherein said means for discharging comprising:

a first pair of plate members, a first plate member attached to a first end of said flexible bag member and a second plate member attached to an opposite second end of said flexible bag member;

a second pair of plate members, a first plate member of said second pair attached to a first end of said outer counterlung member and a second plate member of said second pair attached to an opposite second end of said outer counterlung member, said first plate member of said first pair and said first plate member of said second pair attached to each other and said second plate member of said first pair and said second plate member of said second pair attached to each other; and a discharge outlet in communication with said flexible bag member;

wherein as a diver inhales said outer counterlung collapses proportionally, which also causes a corresponding collapse of said flexible bag member causing a corresponding portion of gas stored within said flexible bag member to be discharged through said discharge outlet.

7. The variable volume ratio compound counterlung of claim 1 further including means for returning gas stored within said outer counterlung member back into the breathing loop during inhalation of the diver.

8. The variable volume ratio compound counterlung of claim 1 wherein said flexible bag member and said outer counterlung communicate with the breathing loop by a manifold inlet.

9. The variable volume ratio compound counterlung of claim 8 wherein said manifold inlet comprises:

a primary gas path member having a first end in communication with an exhaled breath area of the breathing loop a first auxiliary gas path member having a first end attached to said primary gas path member and a second end attached to said outer counterlung, said first auxiliary gas path member providing communication between said primary gas path member and said outer counterlung;

a second auxiliary gas path member having a first end attached to said primary gas path member and a second end attached to said flexible bag member, said second auxiliary gas path member providing communication between said primary gas path member and said flexible bag member; and a first one-way valve disposed within said primary gas path member intermediate the attachment points of said first auxiliary gas path member and said second auxiliary gas path member to said primary gas path.

10. The variable volume ratio compound counterlung of claim 9 further a second one-way valve disposed within said primary gas path member such that the attachment point of said second auxiliary gas path member to said primary gas path member is intermediated said first one-way valve and said second one-way valve.

11. A variable volume ratio compound counterlung for use with a semi-closed circuit breathing apparatus, said breathing apparatus including a breathing loop to allow a majority of exhaled gas to travel therethrough and be cleansed of carbon dioxide and ultimately inhaled by a diver utilizing the breathing apparatus, said compound counterlung comprising:

a flexible bag member for communication with an exhaled gas area of the breathing loop;

an outer counterlung member for communication with an exhaled gas area of the breathing loop, said flexible bag member disposed within said outer counterlung member, said flexible bag member having first and second ends which are attached to said outer counterlung; and a pair of depth sensors operatively associated with said flexible bag member to vary the volume of said flexible bag member with changes in depth;

wherein said flexible bag member is driven by said outer counterlung to discharge gas stored within said flexible bag member depending on the diver's respiratory minute volume; wherein collapsing of said outer counterlung member also returns gas stored within said outer counterlung back into the breathing loop.

12. The variable volume ratio compound counterlung of claim 11 wherein each of said pair of depth sensors comprising:

a housing member;

a pressure sensing element consisting of a control bellow member having a first end and a second end and disposed within said housing member, said bellow member attached at the first end to said housing member;

a control rod having a first end and a second end, the first end of said control rod disposed within said housing member and attached the second end of said bellow member;

a control arm having a first end and a second end, the first end of said control arm attached to the second end of said control rod, the second end of said control arm attached to said flexible bag member.

13. The variable volume ratio compound counterlung of claim 12 wherein said housing member is transparent to allow for external visual verification of gas tight integrity and any pressure/vacuum preload condition of the pressure sensing element.

14. The variable volume ratio compound counterlung of claim 12 wherein changes in depth causes said control bellow member to either compress or expand which in turn also moves said control rod and said control arm simultaneously, wherein the movement of the control arms of said pair of depth sensors varies the volume of said flexible bag member accordingly.

15. The variable volume ratio compound counterlung of claim 11 wherein said flexible bag member and said outer counterlung communicate with the breathing loop by a manifold inlet.

16. The variable volume ratio compound counterlung of claim 15 wherein said manifold inlet comprises:

a primary gas path member having a first end in communication with an exhaled breath area of the breathing loop;

a first auxiliary gas path member having a first end attached to said primary gas path member and a second end attached to said outer counterlung, said first auxiliary gas path member providing communication between said primary gas path member and said outer counterlung;

a second auxiliary gas path member having a first end attached to said primary gas path member and a second end attached to said flexible bag member, said second auxiliary gas path member providing communication between said primary gas path member and said flexible bag member; and a first one-way valve disposed within said primary gas path member intermediate the attachment points of said first auxiliary gas path member and said second auxiliary gas path member to said primary gas path.

17. The variable volume ratio compound counterlung of claim 15 further a second one-way valve disposed within said primary gas path member such that the attachment point of said second auxiliary gas path member to said primary gas path member is intermediated said first one-way valve and said second one-way valve.

18. The variable volume ratio compound counterlung of claim 11 wherein the attachment of said flexible bag member to said outer counterlung member reduces the flexible bag member's ability to expand in one axis while retaining full movement in another axis.

19. The variable volume ratio compound counterlung of claim 11 wherein said depth sensors can be pressure/vacuum biased as a preload condition.

20. The variable volume ratio compound counterlung of claim 11 wherein a discharge of gas from said inner bag member is linked to motion of said outer counterlung member.

* * * * *